United States Patent [19]

Smith

[11] Patent Number: 4,936,553

[45] Date of Patent: Jun. 26, 1990

[54] METHOD FOR RETAINING SLAG DURING THE DISCHARGE OF MOLTEN METAL FROM A VESSEL

[75] Inventor: Colvin W. Smith, Catonsville, Md.

[73] Assignee: Bethlehem Steel Corporation, Bethlehem, Pa.

[21] Appl. No.: 375,161

[22] Filed: Jul. 3, 1989

[51] Int. Cl.[5] ..... B22D 41/10

[52] U.S. Cl. ..... 266/45; 266/230; 222/597

[58] Field of Search ..... 266/45, 227, 230, 271; 222/590, 597, 600

[56] References Cited

U.S. PATENT DOCUMENTS

| | | | |
|---|---|---|---|
| 2,246,144 | 6/1941 | Perrin | 266/45 |
| 2,718,389 | 9/1955 | Perrin | 266/45 |
| 3,944,116 | 3/1976 | Danieli | 222/590 |
| 4,079,918 | 3/1978 | Truppe | 266/45 |
| 4,274,622 | 6/1981 | Ohmori | 266/227 |
| 4,399,986 | 8/1983 | Collins | 266/272 |
| 4,462,574 | 7/1984 | Keenan et al. | 266/45 |
| 4,494,734 | 1/1985 | LaBate | 266/45 |
| 4,525,463 | 6/1985 | Dislich | 501/99 |
| 4,526,349 | 7/1985 | Schwer | 266/45 |
| 4,601,415 | 7/1986 | Koffron | 222/597 |

OTHER PUBLICATIONS

Stahl und Eisen 19 März 1970 pp. 259–260.

33 Metal Producing Nov. 1987 pp. 40–41 "Stoppers: Balls, Darts, and Now Tetron".

*Primary Examiner*—S. Kastler

*Attorney, Agent, or Firm*—John I. Iverson

[57] ABSTRACT

A method for retaining slag in a ladle or similar vessel containing molten metal such as used in the steel industry. Lumps of a highly refractory material having a density between the density of the molten metal and the density of the slag are added to the vessel. As the molten metal is drained from the vessel, the lumps agglomerate around the drain orifice and block the discharge of the slag from the vessel.

12 Claims, 1 Drawing Sheet

METHOD FOR RETAINING SLAG DURING THE DISCHARGE OF MOLTEN METAL FROM A VESSEL

BACKGROUND OF THE INVENTION

This invention relates to a method of minimizing the carryover of slag during the draining of molten metal from a ladle or other vessel. It relates particularly to a method of preventing a significant carryover of slag when molten steel is drained from a ladle or tundish into a continuous casting machine or into ingot molds.

When molten steel has been suitably refined in a furnace and is ready to be cast, the molten steel is tapped or poured into a refractory lined steel transfer ladle. The molten steel often then has further treatment, such as desulfurization, while in the ladle before the ladle is taken to a continuous casting machine or an ingot teeming station.

When the molten steel is tapped from the refining furnace into the ladle, a certain amount of the furnace slag is carried over with the molten steel into the ladle. In addition, while the molten steel is in the ladle, slag forming materials are often added to assist in the further treatment of the steel while in the ladle or to act as an insulation.

Since the slag is less dense than the molten steel, the slag will float on the surface of the molten steel contained in the ladle. However, as the steel is drained from the ladle through an orifice in the bottom of the ladle, some slag will carryover into the tundish of the continuous casting machine or into the ingot mold unless the operator is very careful. Slag in the tundish or the ingot molds results in a poor quality cast steel product. As a result, it is common for operators to leave a substantial amount of steel in the ladle to avoid any slag carryover. This practice results in a poor yield to the steelmaker.

In recent years a number of fabricated plugs or stoppers of a density between that of the molten steel and the slag in the ladle have been developed and patented. These fabricated plugs and stoppers are designed to float at the slag-molten metal interface directly above the drain orifice in the ladle and are drawn into the orifice to prevent the entry of slag as the molten metal drains out of the ladle. The following United States patents describe the various shapes and configurations for these fabricated plugs or stoppers.

| U.S. Pat. No. | | | |
|---|---|---|---|
| 2,246,144 | Perrin | 1941 | Raft |
| 2,718,389 | Perrin | 1955 | Dam |
| 4,462,574 | Keenan | 1984 | Cube |
| 4,494,734 | LaBate | 1985 | Rod Stopper |
| 4,526,349 | Schwer | 1985 | Disc |
| 4,601,415 | Koffron | 1986 | Tapered Polygon |
| 4,610,436 | LaBate | 1986 | Rod Stopper |
| 4,709,903 | LaBate | 1987 | Rod Stopper |
| 4,725,045 | Cutre | 1988 | Cone |
| 4,799,650 | LaBate | 1989 | Rod Stopper |

These fabricated plugs or stoppers are expensive and also require a precise placement of the device right over the drain orifice to be effective. Most require an elaborate boom or mechanical arm to reach into the ladle or vessel and position the plug or stopper right over the drain orifice. If such devices are not accurately positioned, they are ineffective.

SUMMARY OF THE INVENTION

It is an object of this invention to provide a method of minimizing slag carryover during the draining of molten metal from a vessel.

It is a further object of this invention to provide a method of minimizing slag carryover during the draining of molten metal from a vessel which method is relatively inexpensive and does not require special equipment. It has been discovered that the foregoing objectives can be attained by introducing a plurality of refractory lumps into the molten metal in the vessel or ladle with the refractory lumps having a density between the density of the molten metal and the density of the slag floating on top of the molten metal.

DESCRIPTION OF THE PREFERRED EMBODIMENT

Figure 1:
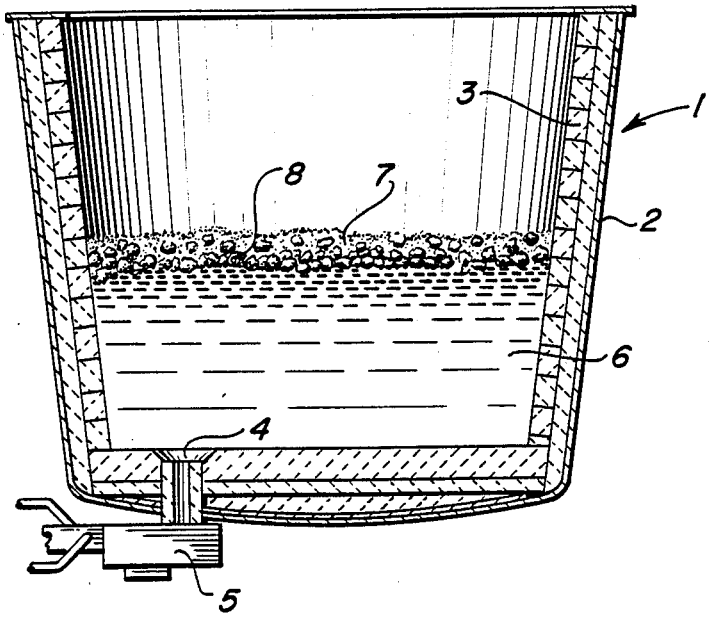
FIG. 1 is a cross-section of a transfer ladle half empty of molten steel illustrating the method of this invention.
Figure 2:
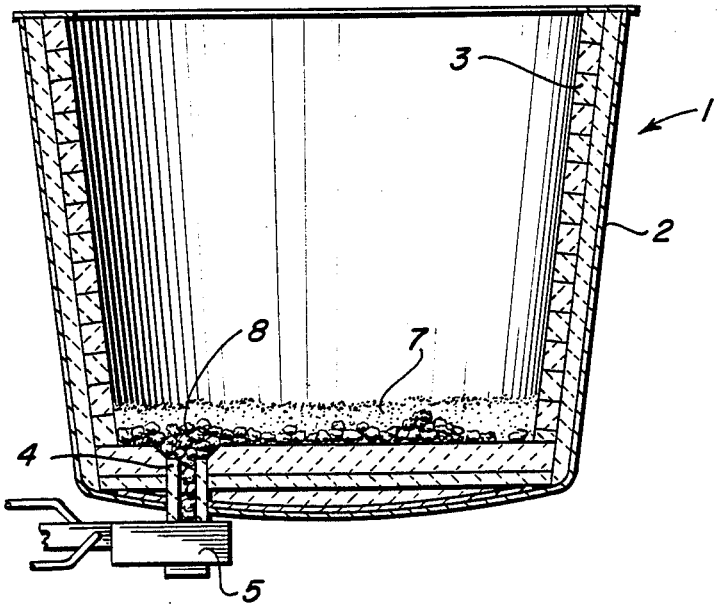
FIG. 2 is a cross-section of a transfer ladle empty of molten steel illustrating the method of this invention.

A preferred method of practicing the method of this invention is illustrated in FIGS. 1 and 2 which shows a conventional open top ladle used in the steelmaking process. Ladle 1 has a steel outer shell 2 and a refractory lining 3 and a drain nozzle or orifice 4 located in the bottom of ladle 1 controlled by a stopper rod or slide gate valve 5. The molten steel 6 contained in the ladle has a layer of slag 7 floating on top of the molten steel 6.

FIG. 1 illustrates the ladle 1 when approximately half of the molten steel 6 has been drained from the ladle through the drain orifice 4. At that time, a quantity of lumps 8 of a highly refractory material are dropped into the ladle 1 from a hopper or chute (not shown). The lumps 8 of refractory material are of a composition that will not melt at the temperatures of the molten steel in the ladle (about 1655° C.) and must be of a density between that of the molten steel (about 7.8 grams per cubic centimeter) and that of the molten slag (about 2.7 grams per cubic centimeter) that floats on top of the molten steel. A preferred refractory material 8 is a magnesia chrome refractory having a density of about 3.5 grams per cubic centimeter and a melting point considerably in excess of that of molten steel (about 1655° C.). The lumps can be uniform in size or nonuniform in size. In a preferred embodiment, the refractory material was crushed to provide a mixture of lumps larger than the diameter of the drain orifice 4, lumps approximately the diameter of the diameter of the drain orifice 4 and lumps smaller than the diameter of the drain orifice 4, the various sized lumps being in about equal proportions by weight in the mixture added to the ladle.

In the case of a 300 ton capacity transfer ladle, approximately 250 pounds (112 kilograms) of the refractory lumps 8 were dropped into the molten steel. The lumps 8 because of their density float on the surface of the molten steel 6 at the slag-metal interface as shown in FIG. 1. As shown in FIG. 2 when just about all of the molten steel 6 has been drained from the ladle 1, the various sized lumps 8 tend to agglomerate and collect around the drain orifice 4 and being solid, will plug and close the drain orifice 4 against the entry of the slag 7.

It has been discovered that the use of the lumps 8 does not require exact placement of the material in the ladle over the drain orifice as in the case of fabricated plugs and stoppers. Furthermore, the agglomerated lumps 8 are easily removed when the ladle is prepared for reuse. It has been discovered that the method of this invention works best with a slag of low viscosity so slag conditioners, such as fluorspar can be added to the ladle prior to the introduction of the refractory lumps 8 if the viscosity of the slag is too high. While the exact amount of lumps to be added is not critical, we have discovered that about 1 pound per ton of steel in the ladle is sufficient to obtain the desired results.

While we have described the method of this invention as applied to a steel transfer ladle, it is contemplated that this invention could be used in any type of vessel that contains molten metal and slag where it is desired to separate the two during the draining of the molten metal from the vessel. The invention would be useful in furnaces, tundishes and molten metal treatment vessels. The use of method of this invention in a continuous casting tundish will reduce the vortex formed about the tundish outlet and thereby prevent the entry of slag from the tundish into the continuous casting mold.

We claim:

1. A method of minimizing slag carryover during the draining of molten metal from a vessel through a drain orifice, said method comprising introducing a plurality of irregular shaped refractory lumps into the molten metal in said vessel, said refractory lumps having a density between the density of the molten metal and the density of the slag.

2. The method of claim 1 in which the lumps are of a substantially uniform size.

3. The method of claim 1 in which the lumps are of a nonuniform size.

4. The method of claim 1 in which some of the lumps are larger than the diameter of said drain orifice and some of said lumps are smaller than the diameter of said drain orifice.

5. The method of claim 1 in which the lumps have a density of between 2.7 and 3.25 grams per cubic centimeter.

6. The method of claim 1 in which the lumps are a chrome magnesia refractory.

7. The method of claim 1 in which the lumps have a melting temperature above 1655° C.

8. The method of claim 1 in which the lumps are introduced into the molten metal at the time when at least one-half of the molten metal has drained from said vessel.

9. The method of claim 1 in which the vessel is a ladle.

10. The method of claim 1 in which the vessel is a tundish.

11. The method of claim 1 in which the vessel is a basic oxygen furnace.

12. The method of claim 1 in which the molten metal is steel.

* * * * *